US005979856A

United States Patent [19]

Hsu

[11] Patent Number: 5,979,856

[45] Date of Patent: Nov. 9, 1999

[54] MUSIC STAND

[76] Inventor: Hsin-Hsuan Hsu, 11 Kung-5 Rd. Kung-2 Indl Zone, Lin-Kou Hsiang, Taipei Hsien, Taiwan

[21] Appl. No.: 09/038,140

[22] Filed: Mar. 11, 1998

[51] Int. Cl.[6] ..... A47B 19/00

[52] U.S. Cl. ..... 248/441.1; 248/454; 248/460

[58] Field of Search ..... 248/441.1, 454, 248/460, 176.1, 178.1

[56] References Cited

U.S. PATENT DOCUMENTS

| | | | |
|---|---|---|---|
| 2,474,532 | 6/1949 | Kitchen | 248/441.1 X |
| 2,508,694 | 5/1950 | Steed | 248/460 X |
| 3,738,606 | 6/1973 | Millen | 248/460 X |
| 4,690,363 | 9/1987 | Koves | 248/454 X |
| 5,037,057 | 8/1991 | Andrews | 248/460 |
| 5,636,824 | 6/1997 | Biasini et al. | 248/441.1 |
| 5,692,719 | 12/1997 | Shepherd | 248/460 |
| 5,791,624 | 8/1998 | Fedrick | 248/460 |
| 5,833,199 | 11/1998 | Benting et al. | 248/441.1 |

*Primary Examiner*—Derek J. Berger

*Attorney, Agent, or Firm*—Jacobson, Price, Holman & Stern, PLLC

[57] ABSTRACT

The present invention relates to an improved music stand that comprises a tripod, a telescopic rod, a music rest, and a connector. The telescopic rod can be disposed on the tripod and the telescopic rod can be readily adjusted for its height. The music rest is configured by an upper half and a lower half that are pivotally connected with each other. By this arrangement, the upper half can be folded onto the lower half. The rear portion of the music rest is provided with a connecting rod that is arranged in traverse direction. The connector has a T-shape configuration and the connecting rod is inserted into the upper portion of the connector. The lower portion of the connector is pivotally attached to the upper end of the telescopic rod and it can be rotated in traverse direction. The upper half of the music rest can be folded onto the lower half of the music rest. The connector can be rotated such that the coupling rod is arranged in parallel with the telescopic rod. The tripod can be retracted. When the music stand is folded, none of the elements is disconnected from each other. The overall size of the music stand can be reduced to a certain extend that is suitable for storing and carrying.

1 Claim, 6 Drawing Sheets

MUSIC STAND

FIELD OF THE INVENTION

The present invention relates to a stand, more particularly, to a music stand that the configuring elements of the music stand can be readily separated and folded when not in use. The folded music stand is convenient to carry or store.

DESCRIPTION OF PRIOR ART

As shown in FIGS. 5 and 6, the conventional music stand generally comprises a supporting tripod (a), a telescopic rod (b), a music rest (c) and a connector (d). The telescopic rod (b) is vertically disposed on the tripod (a). The music rest (c) has an L-shape when viewed from side. The music can be firmly supported onto the music rest (c). The music rest (c) is provided with a curve connecting rod (c1) and the upper and lower portion of the connector (d) is provided with a traverse sleeve (d1) and longitudinal sleeve (d2) respectively. The vertical sleeve (d1) can be directly enveloped onto the top of the telescopic rod (b) and the connecting rod (c1) can be readily inserted and retained within the traverse sleeve (d2).

However, this conventional music stand has the following defects. Firstly, the music stand (c) is fixedly and integrally formed that can not be folded. Consequently, it takes a great deal of space when it is stored. Besides, the connector (d) shall be disassembled from the telescopic rod (b) such that the music rest (c) and the tripod (a) and the telescopic rod (b) can be disconnected. Only by this arrangement, the overall space can be reduced. However, the disconnected tripod (a) and the telescopic rod (c) are not convenient for carrying.

SUMMARY OF THE INVENTION

It is the objective of this invention to provide an improved music stand wherein the music rest can be readily folded to reduce the overall size.

According to another aspect of the present invention, the joint between the music rest and the tripod is also foldable such that the music rest can be folded toward the tripod to reduce the overall size.

According to another aspect of the present invention, the music stand can be readily and quickly folded.

Still according to one aspect of the present invention, wherein when the music stand features a very small size when it is folded.

In order to achieve the objective set forth, the music stand made according to the present invention generally comprises a tripod, a telescopic rod, a music rest, and a connector. The telescopic rod can be disposed on the tripod and the telescopic rod can be readily adjusted for its height. The music rest is configured by an upper half and a lower half that are pivotally connected with each other. By this arrangement, the upper half can be folded onto the lower half. The rear portion of the music rest is provided with a connecting rod that is arranged in traverse direction. The connector has a T-shape configuration and the connecting rod is inserted into the upper portion of the connector. The lower portion of the connector is pivotally attached to the upper end of the telescopic rod and it can be rotated in traverse direction.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
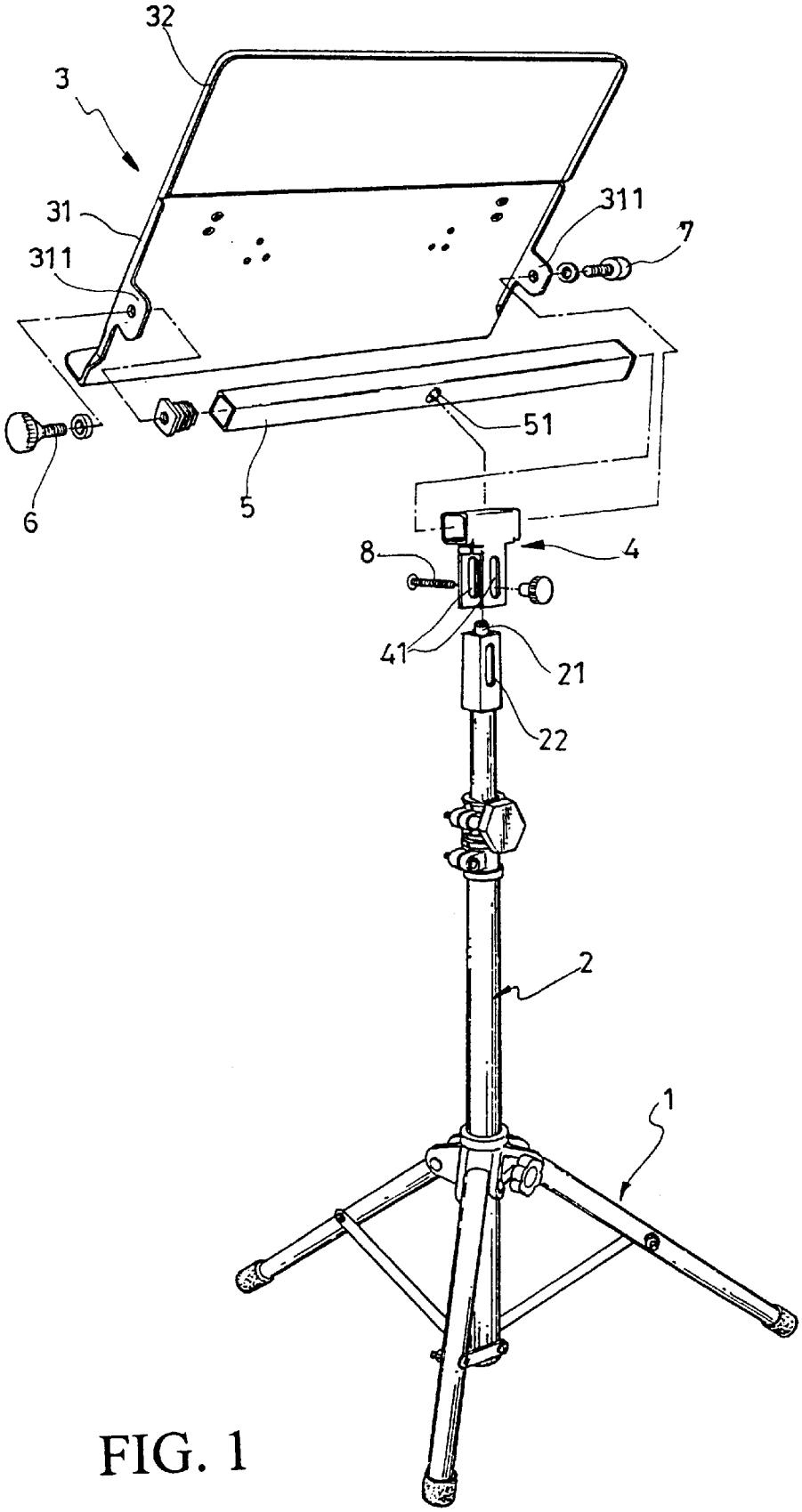
FIG. 1 is an exploded view of the music stand made according to the present invention.
Figure 2:
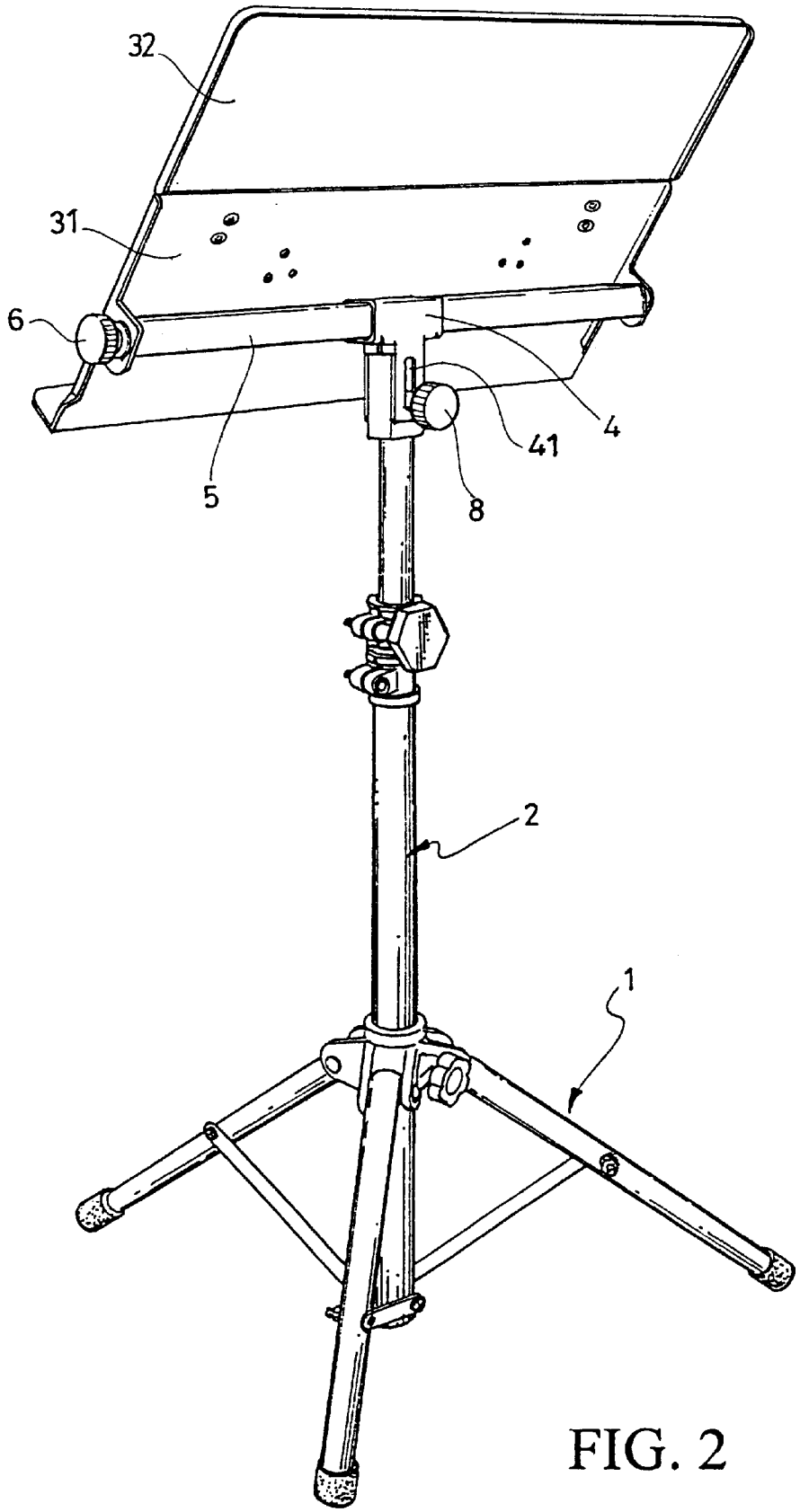
FIG. 2 is a rear view of the music stand shown in FIG. 1.
Figure 3:
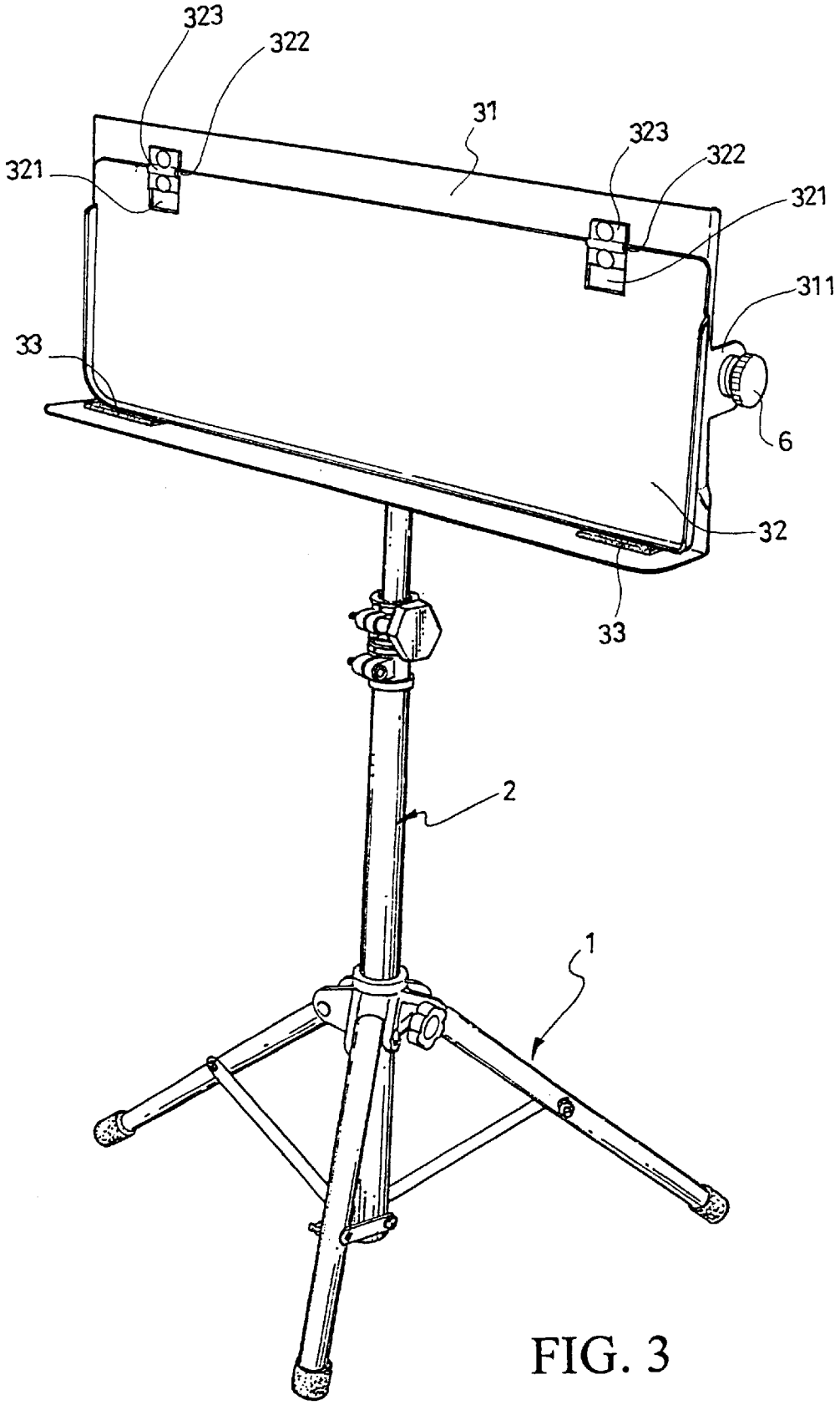
FIG. 3 is a schematic illustration showing the music rest is arranged in folded status.
Figure 4:
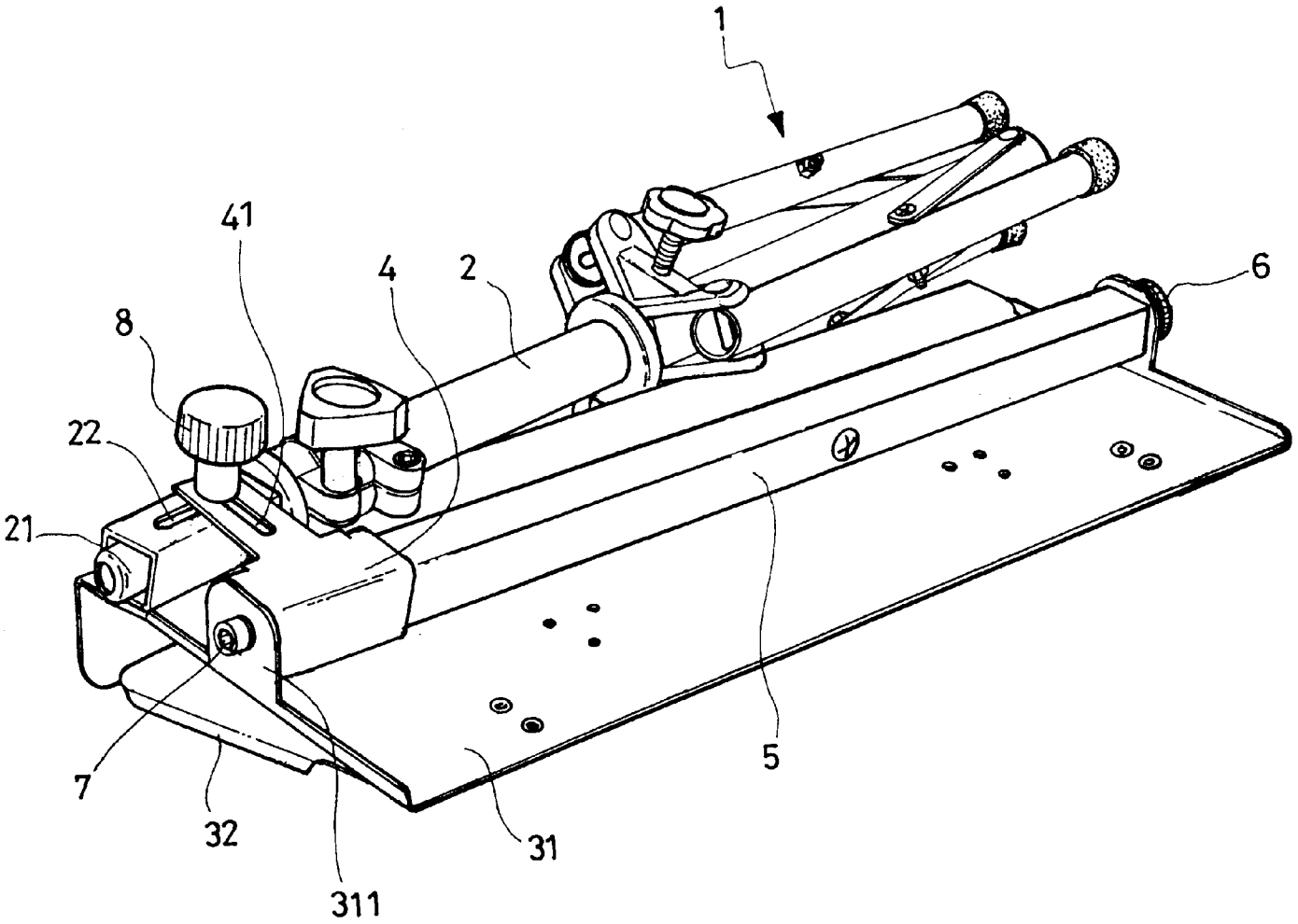
FIG. 4 is still a schematic illustration showing the music stand is arranged in folded status.
Figure 5:
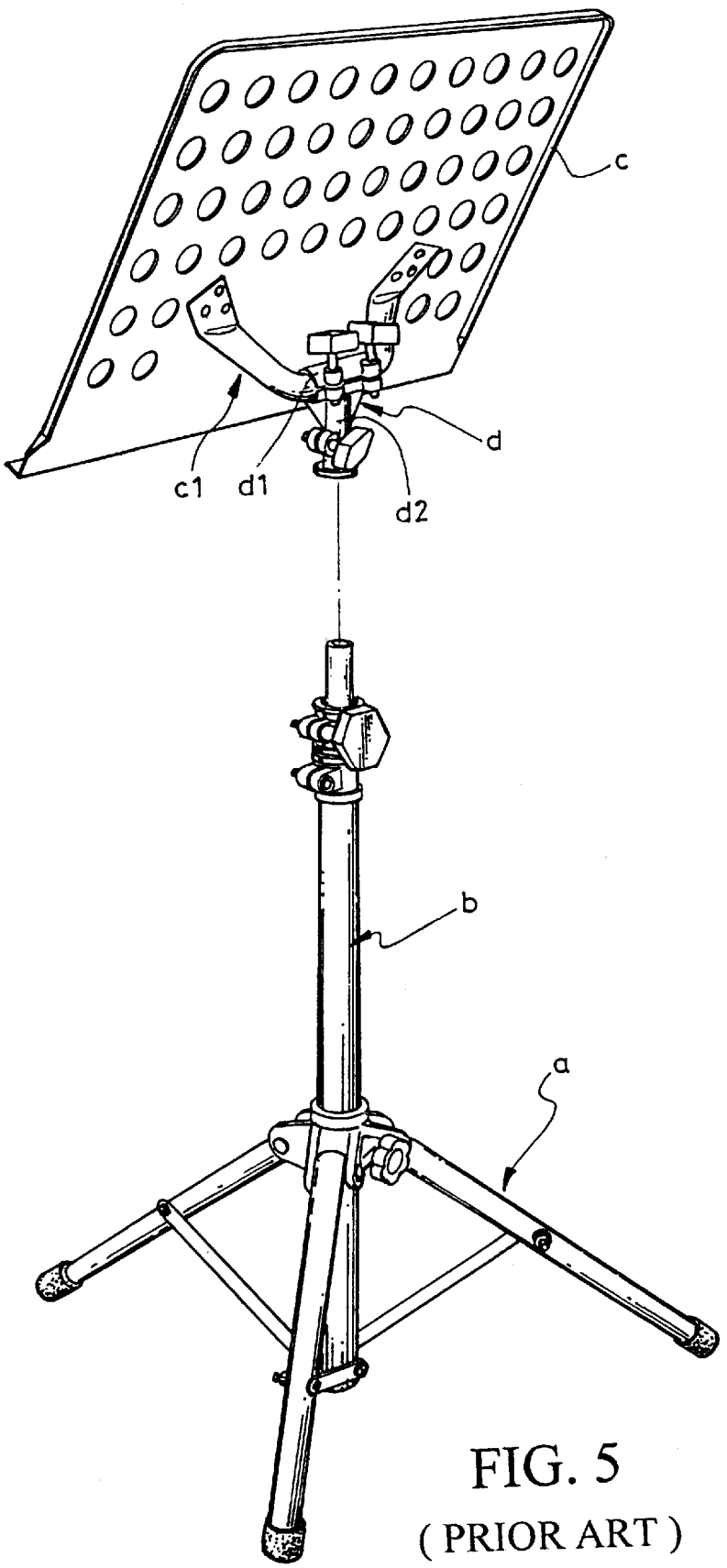
FIG. 5 ( PRIOR ART )
FIG. 5 is an exploded view of the conventional music stand.
Figure 6:
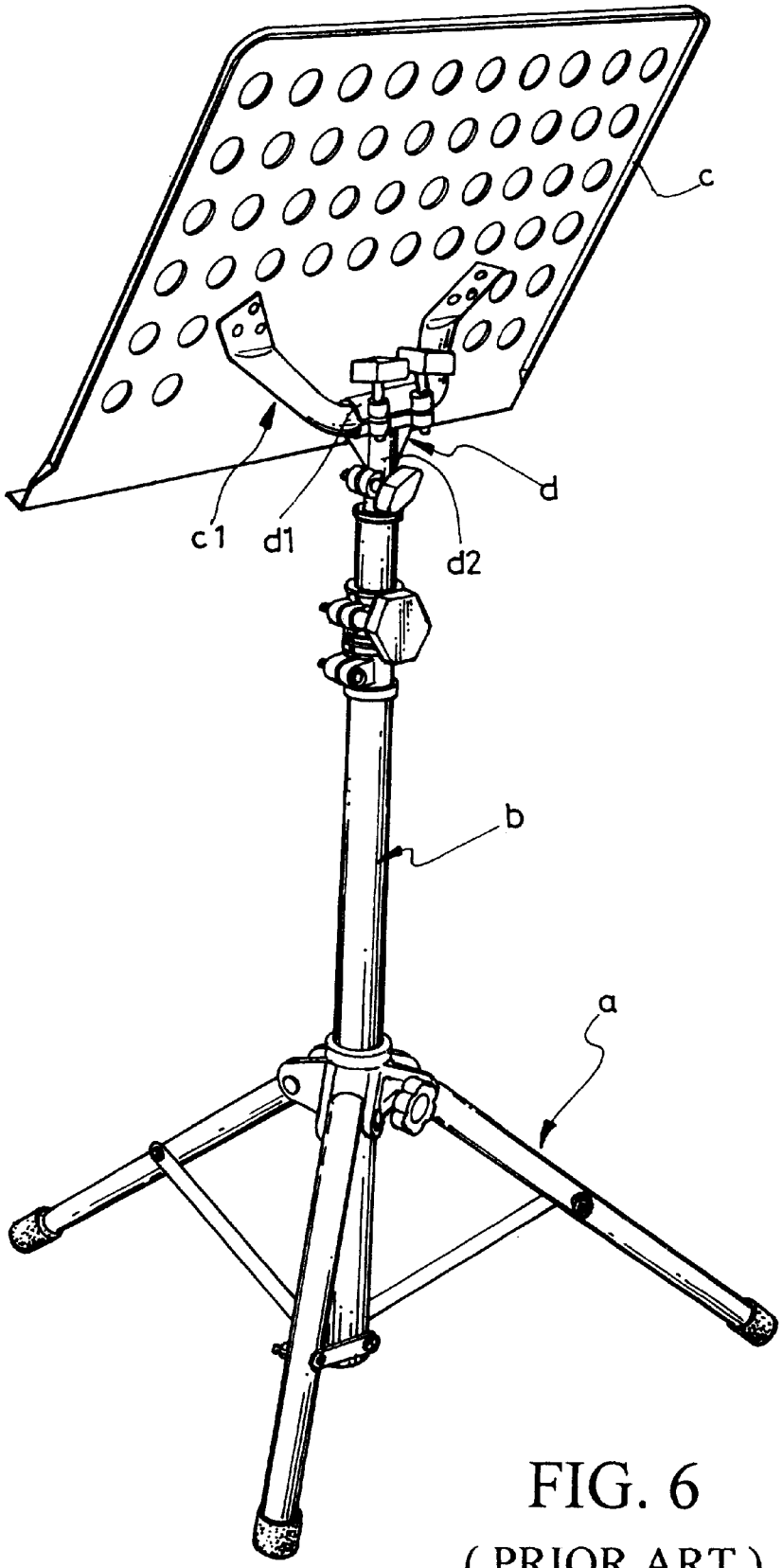
FIG. 6 ( PRIOR ART )
FIG. 6 is a perspective view of the conventional music stand shown in FIG. 5.

Referring to FIGS. 1 to 4, the music stand made according to the present invention generally comprises a tripod 1, a telescopic rod 2, a music rest 3, and a connector 4. The telescopic rod 2 has a hollow configuration and is vertically disposed onto the tripod 1. The height of the telescopic rod 2 can be readily adjusted. The music rest 3 is disposed onto the telescopic rod 2 for firmly supporting the music thereof.

Characterized in that the vertical rod 2 is provided with a projected pin 21 and the sides of the top portion of the telescopic rod 2 is provided with an elongate hole 22, respectively.

The connector 4 has a hollow and T-shape configuration. The sides of the lower portion of the connector 4 is also each provided with an elongate hole 41 corresponding to the elongate hole 22 of the telescopic rod 2.

The music rest 3 is configured by a lower half 31 and an upper half 32 that are pivotally connected with each other. The lower half 31 has an L-shape configuration when it is viewed from side. The lower curve portions of the lower half 31 is each provided with a retaining pad 33. The lower and sides of the upper half 32 is each provided with a square hole 321. The upper half 32 is provided with a pivoting rod 322 adjacent to the square hole 321. The lower edge of the upper half 32 is overlapped onto the upper edge of the lower half 31. A hinge 323 that is arranged on the connecting rod 322 is used to attach the upper half 32 to the lower half 32. By this arrangement, the upper half 32 is capable of bending downward and finally engaged with the retaining pad 33 of the lower half 31. On the other hand, the sides of the lower half 31 is each provided with a pivoting lug 311 that directs backward. A coupling rod 5 is disposed between the pivoting lugs 311. The coupling rod 5 is inserted through the upper portion of the T-shape connector 4. Both ends of the coupling rod 5 is each pivotally connected to the pivoting lug 311 of the lower half 31. The middle portion of the coupling rod 5 is provided with a retaining hole 51 that can be engaged with the projected pin 21 of the telescopic rod 2. A locking bolt 8 is passed through the elongate hole 41 of the connector 4 and the elongate hole 22 of the telescopic rod 2. When the locking bolt 8 is locked up, the music rest 3 can be fixedly arranged onto the telescopic rod 2.

By this arrangement, as the upper half 32 and the lower half 31 of the music rest 3 can be readily folded and the music rest 3 can be folded toward the telescopic rod 2, the overall size of the music stand can be effectively reduced. In folding, the upper half 32 is firstly pivoted toward the lower half 31 till the upper half 32 is engaged with the retaining pad 33 of the lower half 31. Accordingly, the upper half 32 and the lower half 31 are fixedly positioned with each other. Then the locking bolt 8 can be loosened and the coupling rod 5 can be pulled upward. Afterward, the retaining hole 51 of the coupling rod 5 can be released from the projected pin 21 of the telescopic rod 2. Then the connecting rod 4 can be rotated such that the coupling rod 5 and the telescopic rod 2 can be arranged in parallel. Then the locking bolt 8 can be locked. Then the tripod 1 can be retracted inward to complete the folding of the music stand.

When the music stand is folded, the overall size is reduced to a very small and this is very convenient for storage or carrying. Most important, each of the elements of the music stand is still connected with each Other instead of disconnecting from each other. This is specially suitable for carrying from one place to another. None of the elements will be lost.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A music stand including a tripod, a telescopic rod, a music rest, and a connector, said telescopic rod having a hollow configuration and being vertically disposed onto said tripod, a height of said telescopic rod being readily adjusted, said music rest being disposed onto said telescopic rod for firmly supporting music thereon, wherein the improvement comprises said telescopic rod being provided with a projected pin and sides of a top portion of said telescopic rod being provided with an elongate hole, respectively, said connector having a hollow and T-shape configuration, sides of a lower portion of said connector being each provided with an elongate hole corresponding to said elongate hole of said telescopic rod;

said music rest including a lower half and an upper half pivotally connected with each other, wherein said a lower half has an L-shape configuration when viewed from a side, a lower portion of said lower half being each provided with a retaining pad, a lower portion of said upper half being provided with a square hole, said upper half being provided with a connecting rod adjacent to said square hole, a lower edge of said upper half being overlapped onto an upper edge of said lower half, a hinge arranged on said connecting rod being used to attach said upper half to said lower half, wherein said upper half is capable of bending downward and engaging with said retaining pad of said lower half, sides of said lower half being each provided with a pivoting lug, a coupling rod being disposed between said pivoting lugs, said coupling rod being inserted through an upper portion of said T-shape connector, both ends of said coupling rod being each pivotally connected to said pivoting lug of said lower half, a middle portion of said coupling rod being provided with a retaining hole that can be engaged with the projected pin of said telescopic rod, a locking bolt being passed through said elongate holes of said connector and said elongate hole of said telescopic rod, wherein when said locking bolt is locked, said music rest can be fixedly arranged onto said telescopic rod.

* * * * *